US007219432B2

(12) United States Patent
Weng

(10) Patent No.: US 7,219,432 B2
(45) Date of Patent: May 22, 2007

(54) STAMPING AND DIE-CUTTING TOOL WITH A QUICK MOULD CHANGE DESIGN

(76) Inventor: Yang-Ming Weng, No. 84, Guang-Ming Rd., Sec. 2, Wa-Yau Village, Buu Yan Hsiang, Chang Hua Hsien (TW)

( * ) Notice: Subject to any disclaimer, the term of this patent is extended or adjusted under 35 U.S.C. 154(b) by 0 days.

(21) Appl. No.: 11/454,371

(22) Filed: Jun. 15, 2006

(65) Prior Publication Data

US 2006/0230811 A1 Oct. 19, 2006

Related U.S. Application Data

(63) Continuation-in-part of application No. 10/986,598, filed on Nov. 13, 2004, now abandoned.

(51) Int. Cl.
*B26F 1/00* (2006.01)
*B26F 1/14* (2006.01)

(52) U.S. Cl. ..... 30/358; 30/229; 30/315; 30/363; 83/684; 83/685; 83/698.91; 101/3.1; 101/31.1; 400/127; 400/134.4; 72/324; 72/409.01

(58) Field of Classification Search ..... 30/358, 30/363, 362, 233, 316, 364, 366, 312, 368, 30/119, 178, 229, 315, 131, 326, 299; 101/31, 101/28, 3.1, 31.1; 400/134.4, 132, 127, 129, 400/133, 134.2; 72/324–326, 409.01; 164/139; 100/265, 292; 52/749.1, DIG. 1, 127.7, 52/127.9, 127.11; 29/566, 566.1, 566.2; 83/588, 684, 685, 698.91
See application file for complete search history.

(56) References Cited

U.S. PATENT DOCUMENTS 1,365,401 A * 1/1921 Hellberg ..... 101/31.1
2,202,255 A * 5/1940 Jackson et al. ..... 101/31.1
2,329,387 A * 9/1943 Brenning ..... 30/229
2,690,009 A * 9/1954 Welk ..... 30/229
2,706,447 A * 4/1955 Priesmeyer ..... 101/31.1
3,260,192 A * 7/1966 Ostenberg ..... 101/31.1
4,891,886 A * 1/1990 Diamant et al. ..... 30/363
5,819,647 A * 10/1998 Balosh ..... 101/31.1
6,718,641 B2 * 4/2004 Hsuan ..... 30/363
2006/0272165 A1 * 12/2006 Brenchley ..... 30/358

* cited by examiner

*Primary Examiner*—Boyer D. Ashley
*Assistant Examiner*—Ghassem Alie
(74) *Attorney, Agent, or Firm*—Charles E. Baxley

(57) ABSTRACT

A stamping and die-cutting tool with quick mould change design comprises: a casing and a pushing member. The pushing member has a pushing portion to be fixed at an extended position and a retracted position alternatively after being pressed repeatedly. The pushing member is fixed in the casing. A mould have an attractive surface and is moveably disposed in the casing in such a manner that the attractive surface is attracted to the pushing portion of the pushing member; by pressing the mould, the pushing member will be moved out of and retracted into the casing, so that the mould can be changed easily.

2 Claims, 6 Drawing Sheets

STAMPING AND DIE-CUTTING TOOL WITH A QUICK MOULD CHANGE DESIGN

This application is a continuation of part of U.S. patent application Ser. No. 10/986,598 filed on Nov. 13, 2004 now abandoned, which claims the benefit of the earlier filing date.

BACKGROUND OF THE INVENTION

1. Field of the Invention

The present invention relates to a stamping and die-cutting tool capable of stamping or cutting out a desired pattern from a given material, and more particularly to a stamping and die-cutting tool with quick mould change design.

2. Description of the Prior Arts

With reference to FIG. 1, a conventional stamping and die-cutting tool with a mould change design includes a casing 11 on which is provided with a handle 12. The handle 12 is to be pressed by the user and will return to its original position after being pressed. In the front end of the casing 11 is disposed a mould 13, and a pushing member 14 is disposed in the case 11 and located opposite to the abutment surface 131 of the mould 13. By pulling a pulling portion 141 of the pushing member 14, a pushing portion 142 of the pushing member 14 will be caused to push the mould 13 out of the casing 11, so that the mould 13 can be replaced. However, this conventional stamping tool still has some problems:

First, during the course of changing the mould 13, the user has to hold the casing 11 with one hand while pressing the pushing member 14 with another hand, so that the mould 13 will probably fall to floor, in case that the user pull too hard, thus leading to a damage.

Second, for aesthetic reasons, the pushing member 14 is hidden inside the casing 11 without being pressed. In this case, before changing the mould 13, the user has to find out pushing member 14 and then press the pulling portion 141. This is time-consuming.

Third, the pushing member 14 is <-shaped, and the connecting portion between the pulling portion 141 and the pushing portion 142 is likely to be broken if an overgreat force is applied.

The present invention has arisen to mitigate and/or obviate the afore-described disadvantages.

SUMMARY OF THE INVENTION

The primary objective of the present invention is to provide a stamping and die-cutting tool with quick mould change design that is capable of changing the mould easily.

A stamping and die-cutting tool with quick mould change design provided in accordance with the present invention comprises:

a casing;

a pushing member have a pushing portion to be fixed at an extended position and a retracted position alternatively after being pressed repeatedly, the pushing member is fixed in the casing;

a mould have an attractive surface and is moveably disposed in the casing in such a manner that the attractive surface is attracted to the pushing portion of the pushing member;

by pressing the mould, the pushing member will be moved out of and retracted into the casing, so that the mould can be changed easily.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
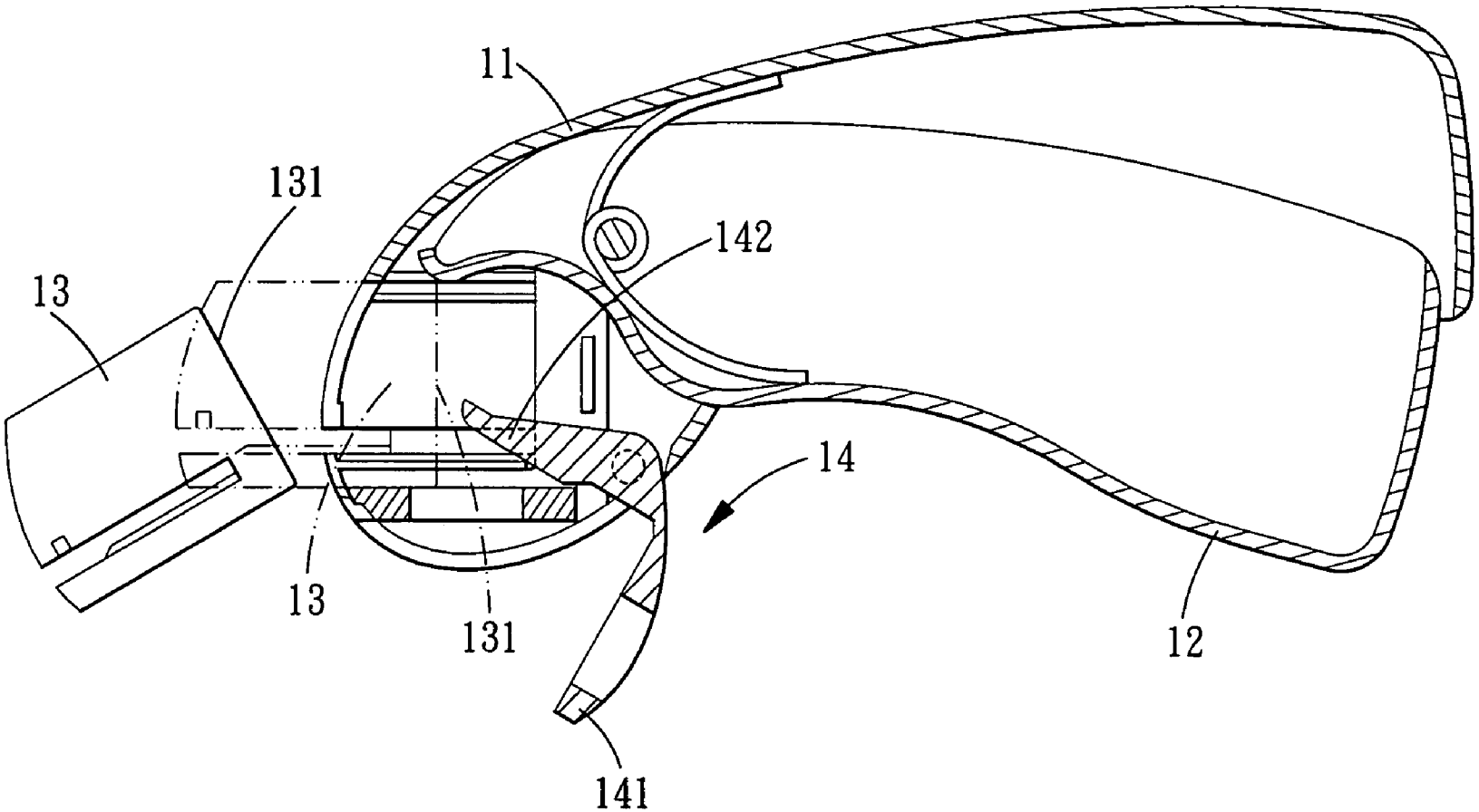
FIG. 1 PRIOR ART
FIG. 1 is a cross sectional view of a conventional stamping and die-cutting tool with quick mould change design.
Figure 2:
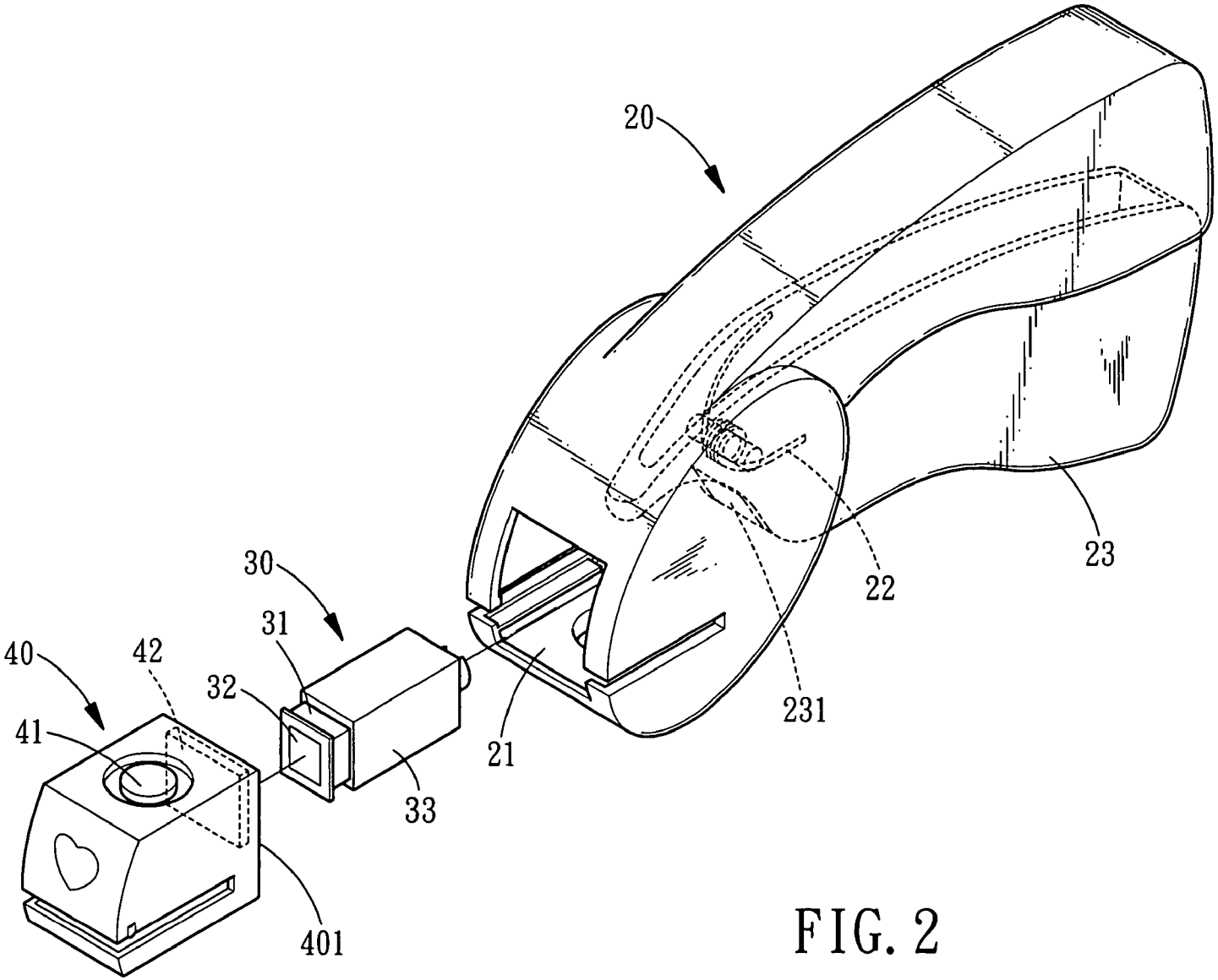
FIG. 2 is an exploded view of a stamping and die-cutting tool with quick mould change design in accordance with the present invention.
Figure 3:
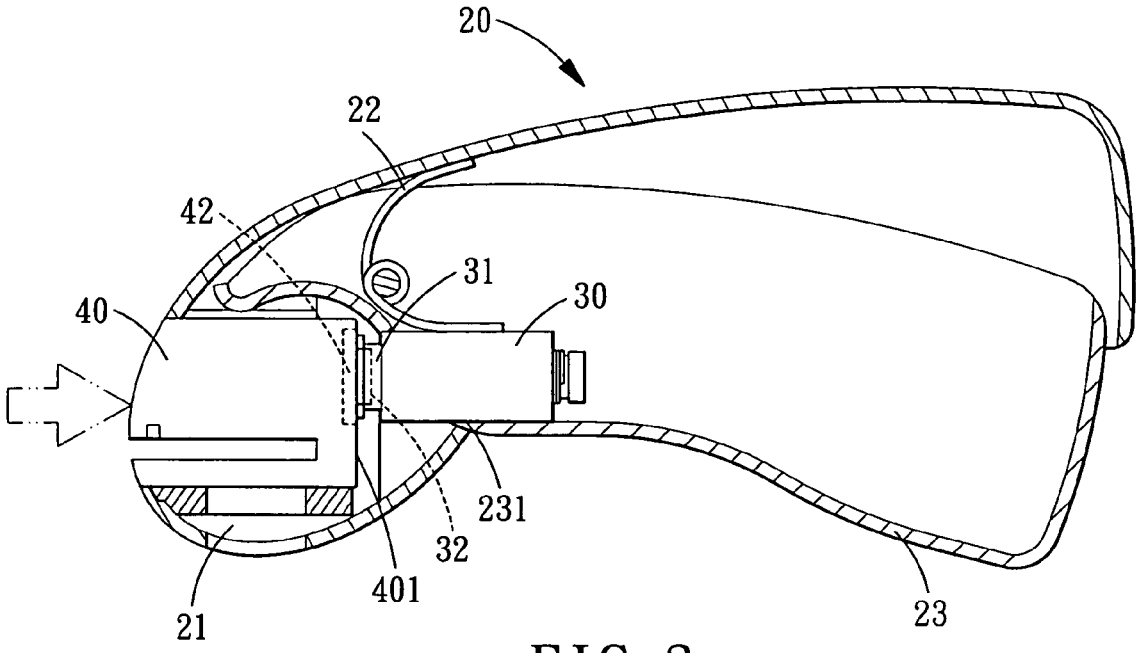
FIG. 3 is a cross sectional view of a stamping and die-cutting tool with quick mould change design in accordance with the present invention.

Referring to FIGS. 2 and 3, a stamping and die-cutting tool with quick mould change design is shown and comprises: a casing 20, a pushing member 30 and a mould 40.

The casing 20 is defined at the front end thereof with a chamber 21, a handle 23 is fixed at the rear end of the casing 20 by a torsion spring 22 so that the handle 23 will return to its original position after being pressed. At the front end of the handle 23 is defined a cavity 231.

The pushing member 30 includes a pushing portion 31 which can be fixed at an extended position and a retracted position alternatively after being pressed repeatedly. A magnet 32 is provided at the end of the pushing portion 31, and the pushing member 30 is fixed in the casing 20 and inserted in the cavity 231 of the handle 23.

The mould 40 is provided with a die 41 moveable in a vertical direction, under an attractive surface 401 of the mould 40 is disposed a iron member 42, and then the mould 40 is moveably disposed in the chamber 21 of the casing 20 in such a manner that the attractive surface 401 is attracted to the pushing portion 31 of the pushing member 30.

Figure 4:
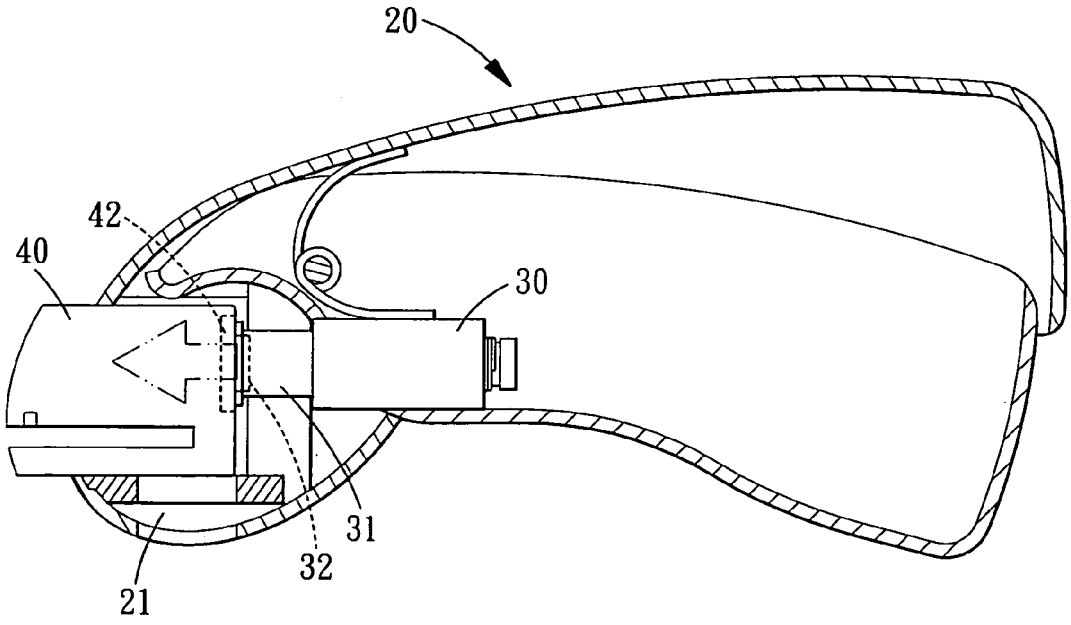
FIG. 4 is an operational view of a stamping and die-cutting tool with quick mould change design in accordance with the present invention.

For a better understanding of the invention, its operating advantages and specific objects attained by its uses, reference should be made to FIGS. 3 and 4. When in use, the pushing portion 31 of the pushing member 30 is fixed in a retracted position, as shown in FIG. 3. When the user presses the mould 40 in a horizontal direction, since the mould 40 is attracted to the pushing member 30, the pushing portion 31 of the pushing member 30 will move to the extended position after being pressed. Thus, the mould 40 will be pushed out of the casing 20, allowing for easy replacement. After replacement, by pressing the mould 40 again in a horizontal direction, the pushing portion 31 of the pushing member 30 will move back to the retracted position, and the mould 40 will be moved by the pushing portion 31 into the chamber 21 again. In this way, the mould 40 can be changed easily.

The mould 40 can be prevented from falling off the casing 20, during the course of replacing, since it is magnetically attracted to the pushing member 30. Furthermore, the magnet 32 can be disposed beneath the attractive surface of the mould 40 and the iron member 42 can be fixed to the end of the pushing member 30, this alternative still allows the mould 40 to be attracted to the pushing member 30, and the still can be replaced easily.

Figure 5:
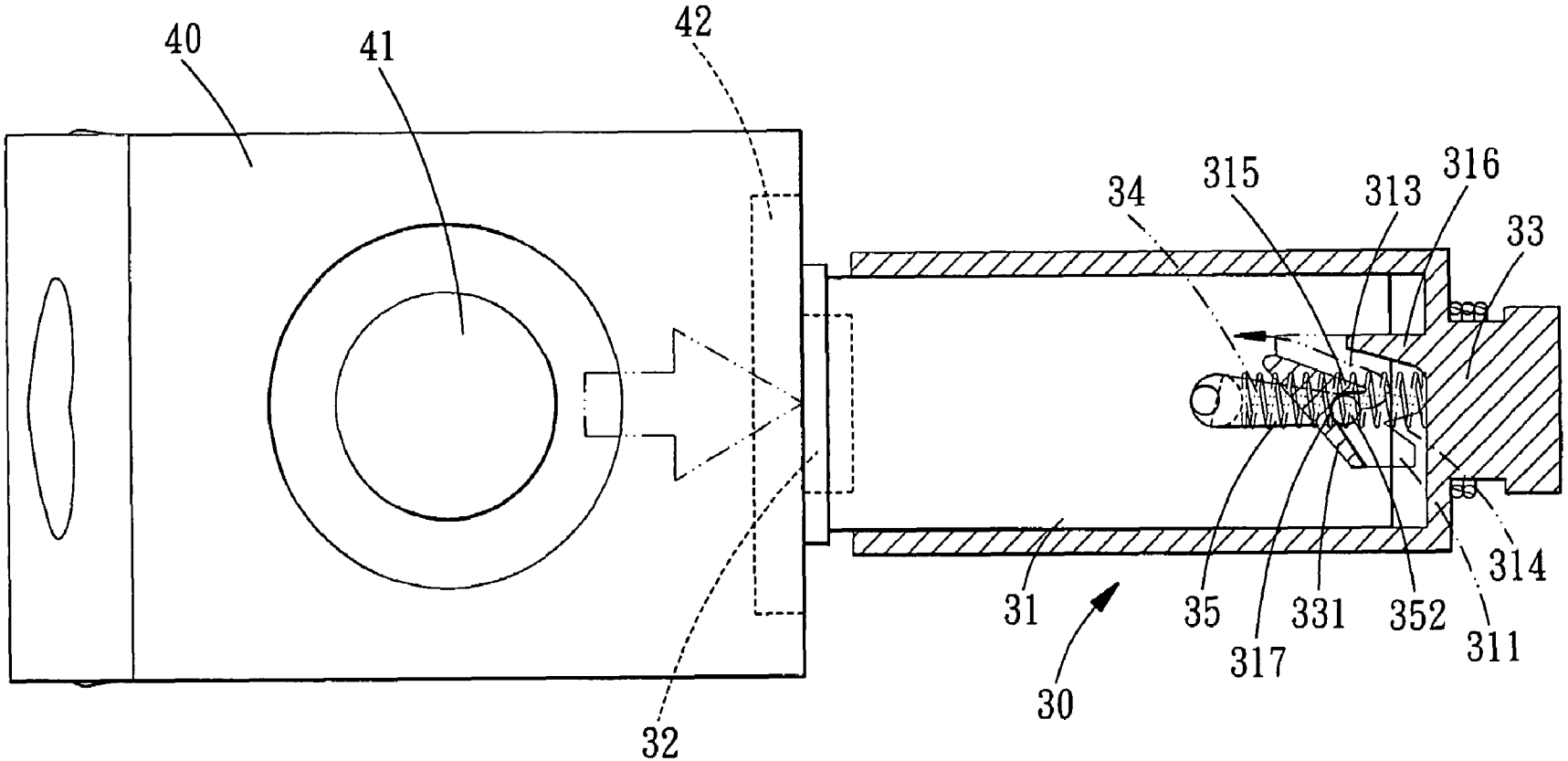
FIG. 5 is an operational view of the pushing member of the stamping and die-cutting tool with quick mould change design in accordance with the present invention.
Figure 6:
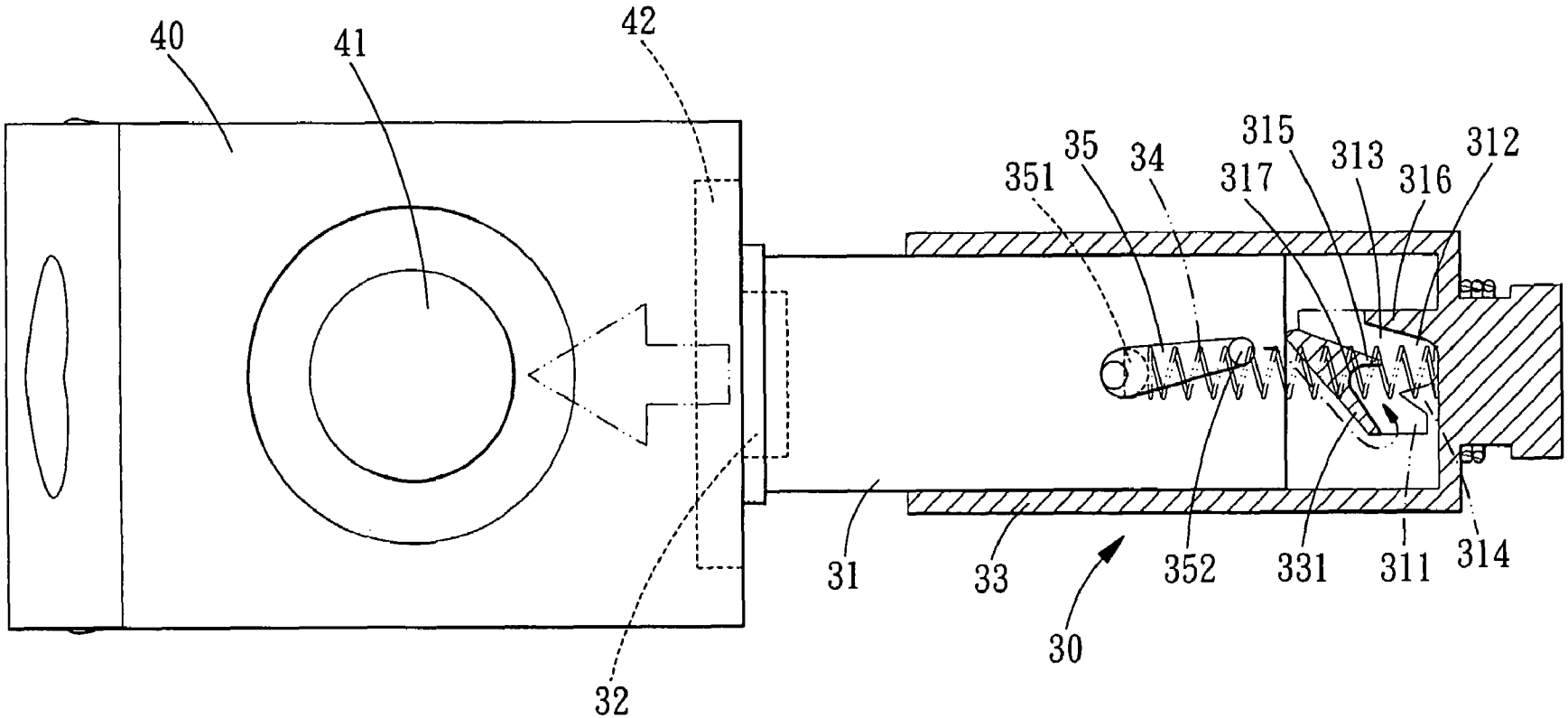
FIG. 6 is another operational view of the pushing member of the stamping and die-cutting tool with quick mould change design in accordance with the present invention.
Figure 7:
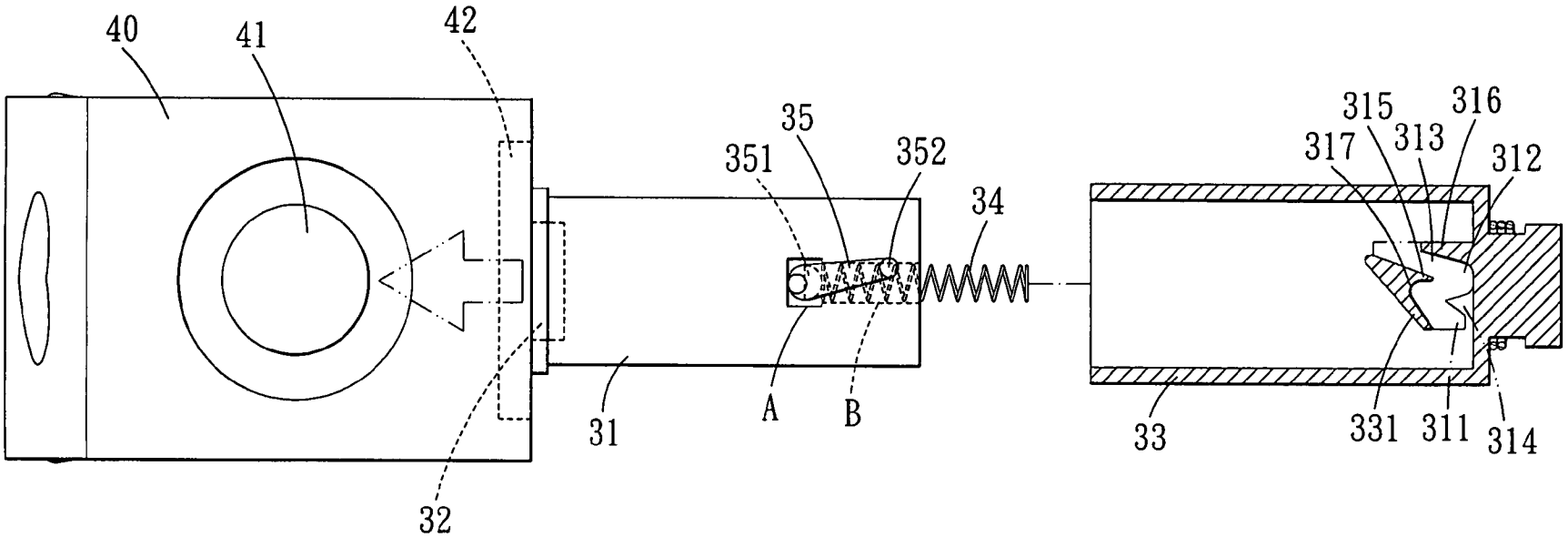
FIG. 7 is an illustrative view of showing the pressing member structure in accordance with the present invention.

Since it is a conventional method of fixing the pushing portion 31 of the pushing member 30 at the extended position and the retracted position, this functionality is briefly illustrated with reference to FIGS. 5 and 6:

The pushing member 30 includes the pushing portion 31, a base 33, a compression spring 34 and a positioning lever 35. The pushing portion 31 is retractably disposed in the base 33. The pushing portion 31 is defined with a recess A and a through hole B vertical to the recess A, and the through hole B is also vertical to the inner wall of the base 33.

In the surface of the base 33 of the pushing member 30 is formed a μ-shaped positioning groove that is divided into a first section 311, a second section 312 and a third section 313. At the connection of the respective sections is formed a protruding first stop portion 314, a reverse second stop portion 315 and a third stop portion 316. In the second stop portion 315 is formed a notch 317. Each of the first section 311 and second section 313 defines an opening. One end of the compression spring 34 is abutted against the inner wall of the base 33 and located between the pushing portion 31 and the base 33, while another end of the compression spring 34 is inserted in the through hole B of the pressing portion 31 and extends to the recess A.

A positioning lever 35 is pivotally assembled to the pushing member 31 and is provided at both ends thereof with an arc-shaped pivotal block 351 and a hook 352. The arc-shaped pivotal block 351 is pivotally disposed in the recess A of the pushing member 31, and the arc surface of the arc-shaped pivotal block 351 is pushed by the compression spring 34, so as to enable the positioning lever 35 to be maintained in a skew position. The arc-shaped pivotal block 351 is pivotally fixed to the base 33 in such a manner the hook 352 is movably positioned in the respective annular sections of the base 33. When the hook 352 is forced to move within the respective annular sections of the base, an end of the compression spring 34 is positioned on the base 33 and another end of the compression spring 34 presses against the arc-shaped pivotal block 351 of the positioning lever 35, thus providing a restoring stress for allowing the positioning lever 35 to swing toward the notch 317 and to withdraw from the third section 313.

The operation of this embodiment is that: when the user aligns the pushing member 31 with the base 33 and pushing it towards the base 33 (retraction), the hook 352 of the positioning lever 35 is located in the opening of the first section 311 of the base 33, the pushing portion 31 will retracts while cooperating with the compressing spring 34 to make the hook 352 move along the first stop 314 until it is stopped by the reverse second stop portion 315, and the hook 352 will fall into the notch 317 of the second section and will be positioned therein.

If the user pushes the pushing portion 31 toward the base 33 again (retraction), the hook 352 of the positioning lever 35 will move along the second stop portion 315 and slide to the third section 313 (being pushed toward the third section 313 by the compression spring 34), thus making the hook 352 disengage from the opening in the lower portion of the third section 313. in this way, the pushing portion 31 being pushed by the compression spring 34 can make the hook 352 slide to its original portion. In this way, the pushing member 30 can be fixed at an extended position and a retracted position alternatively after being pressed repeatedly.

While we have shown and described various embodiments in accordance with the present invention, it should be clear to those skilled in the art that further embodiments may be made without departing from the scope of the present invention.

What is claimed is:

1. A stamping and die-cutting tool with quick mould change design comprising:

a casing;

a pushing member having a pushing portion to be fixed at an extended position and a retracted position alternatively after being pressed repeatedly, the pushing member fixed in the casing;

a mould having an attractive surface and being moveably disposed in the casing in such a manner that the attractive surface is attracted to the pushing portion of the pushing member, wherein a magnet is provided on a front side of the pushing portion of the pushing member, and an iron member is disposed inside the attractive surface of the mould opposite the magnet, so that the pushing member is attracted to the mould; by pressing the mould;

by pressing the mould, the pushing member will be moved out of and retracted into the casing, so that the mould is allowed to be changed easily.

2. The stamping and die-cutting tool with quick mould change design as claimed in claim 1, wherein the casing is provided with a handle which can move back to its original position after being pressed, at an end of the handle is defined a cavity provided for insertion of the pushing member.

* * * * *